United States Patent [19]

Sonnenberg

[11] 4,324,813

[45] Apr. 13, 1982

[54] METHOD AND APPARATUS FOR CURING LACQUER LAYERS WITH HIGH-ENERGY ELECTRONS

[75] Inventor: Karl-Heinz Sonnenberg, Weyhausen, Fed. Rep. of Germany

[73] Assignee: Volkswagenwerk Aktiengesellschaft, Wolfsburg, Fed. Rep. of Germany

[21] Appl. No.: 151,975

[22] Filed: May 21, 1980

[30] Foreign Application Priority Data

Jun. 1, 1979 [DE] Fed. Rep. of Germany ..... 2922367

[51] Int. Cl.[3] ..... B05D 3/06

[52] U.S. Cl. ..... 427/44; 250/492.1; 427/35

[58] Field of Search ..... 427/44, 35, 36; 250/492 R, 492 A, 492 B

[56] References Cited

U.S. PATENT DOCUMENTS 2,785,313 3/1957 Trump ..... 250/492
3,247,012 4/1966 Burlant ..... 427/44
3,418,155 12/1968 Colvin et al. ..... 427/44
3,746,541 7/1973 Sharp ..... 427/54.1

*Primary Examiner*—John H. Newsome
*Attorney, Agent, or Firm*—Spencer & Kaye

[57] ABSTRACT

An arrangement for curing, by electron beam irradiation, a lacquer coating carried on an article having a complex configuration. The arrangement includes an assembly formed of an electron accelerator for obtaining highly accelerated, high-energy electrons and a scanner for forming, from the electrons, a spread-out electron beam directed onto the article through an electron outlet window. The article has a first surface position inaccessible to direct electron beam radiation and a second surface portion arranged at an oblique angle with respect to the direction of the direct electron beam radiation and exposed to the direct electron beam radiation. The second surface portion is further oriented towards the first surface portion, whereby one part of the electrons impinging on the second surface portion is reflected therefrom onto the first surface portion.

5 Claims, 1 Drawing Figure

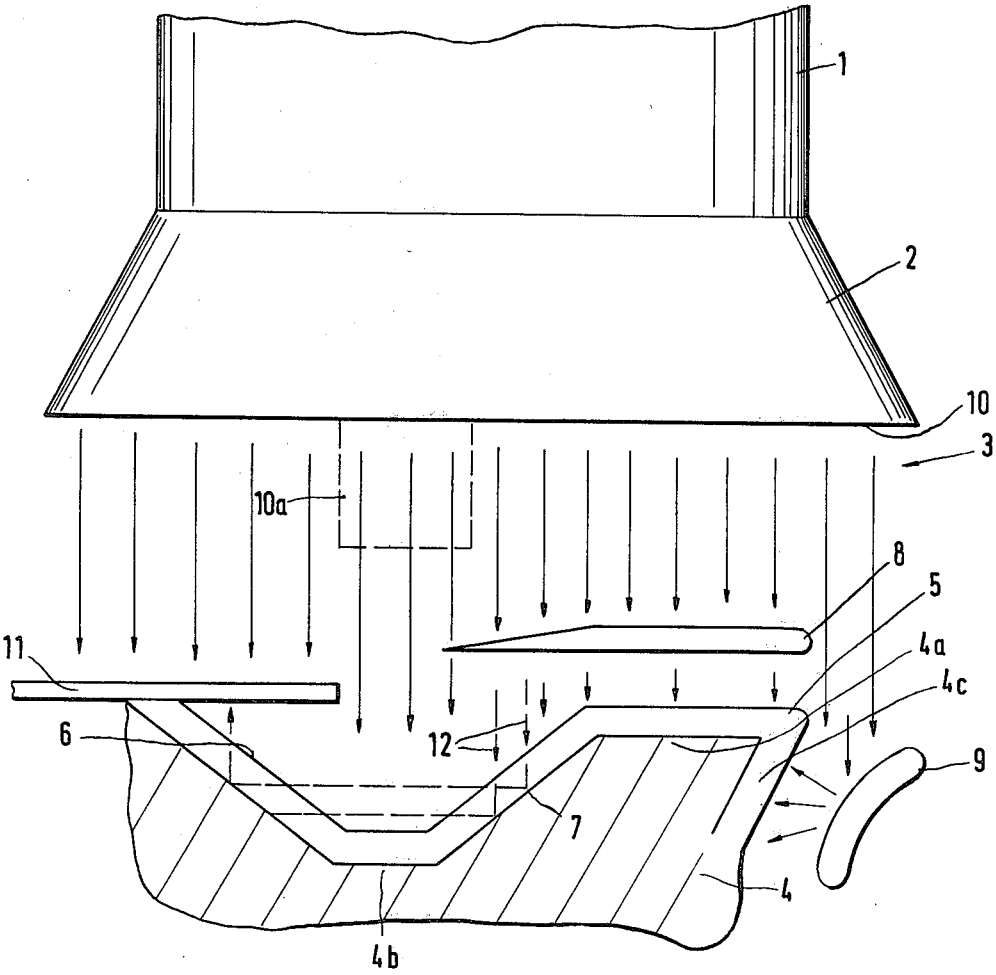
1
2
10
3
10a
8
5
11
4a
4c
6
12
9
7
4
4b

METHOD AND APPARATUS FOR CURING LACQUER LAYERS WITH HIGH-ENERGY ELECTRONS

BACKGROUND OF THE INVENTION

This invention relates to a method and an apparatus for curing (hardening) lacquer layers applied to an article surface (substrate) of complex configuration, by means of highly accelerated, high-energy electrons which, by means of a scanner, are spread out in a fan-like beam and which are directed onto the article through an electron outlet window.

It is known to irradiate lacquer coatings by highly accelerated, high-energy electrons for the purpose of curing the lacquer. The electrons penetrate through opaque materials and therefore are capable of curing even pigmented lacquers. The ionizing radiation effects an interaction between the electrons on the one hand and the atoms of the irradiated layer, on the other hand, whereby the highly accelerated electrons transfer energy to the lacquer layer, especially to the double bonds of the lacquer molecules.

Curing of lacquers by means of electron irradiation has, among others, the advantage that the pigmented and transparent lacquer systems are cured uniformly and further, the curing periods are very short and thus, a high production output is achieved. Further, high-quality surfaces are obtained which, even in case of a thin layer, have superior filling properties.

The electrons are generated by an electron accelerator in which a cathode of an accelerating tube emits electrons under high potential difference and then the electrons are accelerated in a high-voltage electric field. In a downstream-arranged scanner the electrons are, by means of alternating fields, deflected back and forth and thus are spread into a fan-like beam bundle. Such an electron beam leaves the high vacuum through an at least substantially beam-transparent outlet window made, for example, of a particular titanium alloy, and then is deflected onto the article to be irradiated. During passage through the electron outlet window (which seals the electron accelerator and the scanner from the external environment and atmosphere pressure), one part of the radiation output of the electron beam is absorbed so that a minimum electron energy has to be maintained.

Conventionally, the electron beam curing is utilized in case of articles which have a flat, planar surface such as plates or foils, as described, for example, in an article by B. P. Offermann: "Lackhärtung mit energiereichen Elektronen" (Curing of Lacquers with High-Energy Electrons), ETZ-B, Volume 23 (1971), Issue 25, or mentioned in an article in VDI-Nachrichten of May 11th, 1979 (page 1, last paragraph). Concerning the treatment of a polyethylene insulation of an electric cable (which thus is not a planar article), it is further known, as described, for example, in German Auslegeschrift (Published Accepted Patent Application) No. 1,046,789, to bring one or more particular metallic surfaces into the path of the electron beam in order to obtain a uniform irradiation of the insulation. The high-energy electrons are scattered on the metal surfaces and deflected in such a manner that they penetrate the cable insulation. For improving the uniformity of the irradiation of the cable, either an additional shield is provided which acts as a screen against the direct radiation of the high-energy electrons or the cable is rotated.

SUMMARY OF THE INVENTION

It is an object of the invention to provide an improved arrangement for the curing of lacquer layers applied to articles, by means of highly accelerated, high-energy electrons wherein even articles of complex configuration, including surface areas not accessible by direct electron beam radiation (hereafter "hidden surfaces") can be treated by the electrons.

This object and others to become apparent as the specification progresses, are accomplished by the invention, according to which, briefly stated, the article has in the vicinity of at least one part of the hidden surfaces a surface which is exposed to direct radiation and which is obliquely oriented with respect to the direction of the direct radiation such that one part of the incident electrons is deflected by reflection onto the hidden coated surfaces.

Thus, the coated article to be irradiated is, in the vicinity of at least one part of hidden coated surfaces, for example, undercut portions, intentionally provided with particular surfaces exposed directly to radiation. These particular surfaces are oblique with respect to the direction of electron beam radiation and are oriented towards the hidden surfaces. Thus, in such an arrangement there is intentionally utilized the back scattering effect of the coated substrate, that is, the fact that a substantial portion of the electrons impinging upon the oblique surface does not interact with the atoms of the lacquer layer, but is reflected from the coated substrate and thus deflected onto the adjacent hidden surfaces. Further, there is intentionally exploited the fact that some of the electrons pass twice through the lacquer layer of the oblique surface, that is, first, as they enter the lacquer layer and second, after they are reflected from the substrate, whereby the reaction probability is increased, and further, that the reaction probability in the lacquer layer irradiated indirectly by the reflected electrons is greater than in a directly irradiated lacquer layer because of the lower velocity of the reflected electrons. Particularly good results are obtained with coated metals which have a high atomic number in the periodic system.

In order to homogenize the path-dependent irradiation intensity, that is, in order to render at least approximately uniform the intensity with which the individual coated areas are irradiated, independently of their distance from the electron outlet window, first, the intensity of the electron beam passing through the outlet window is so determined that the hidden surfaces are irradiated with such a quantity of high-energy electrons reflected from the oblique surfaces that is sufficient for the curing of the lacquer coating on the hidden surfaces and second, in the zone of at least one part of the coated surfaces exposed directly to radiation, absorbers are arranged in the path of the electron beams for absorbing one part of the electrons so that a harmful excessive irradiation of the immediately adjacent coated areas is prevented.

In order to avoid, at least to a substantial measure, range losses of the electrons due to the different path lengths, according to an advantageous feature of the invention, the distance between the electron outlet window and at least all those coated surfaces which are exposed to a direct irradiation, is rendered at least approximately uniform by providing that the outlet window is not planar but has a surface structure which is adapted as much as possible to the surface configuration of the article to be irradiated. For the sake of simplicity one is generally limited to a coarse adaptation to such a surface configuration. Such an arrangement results in the additional advantage that the space which is under normal (atmospheric) pressure and which has to be traversed by the electrons is reduced, so that, if required, particular gaseous media (such as nitrogen, argon, helium or the like) can be introduced in a relatively simple manner into such a space.

Advantageously, an electron beam control may be provided, by means of which the intensity of the electron beam passing through the outlet window is so controlled that the radiation intensity is at least approximately the same for those surfaces which lie relatively close to the electron outlet window and for those surfaces which are relatively remote therefrom. Again, in order to maintain the control circuitry simple, a relatively coarse adaptation of the radiation intensity to the surface configuration is effected.

According to a further feature of the invention, in the vicinity of at least one part of the hidden coated surfaces, directly irradiated scattering bodies are arranged, whose effective outer faces are adapted to the geometry of the hidden surfaces and which ensure that a sufficient quantity of electrons is reflected therefrom onto the hidden surfaces.

BRIEF DESCRIPTION OF THE FIGURE

The sole FIGURE illustrates a preferred embodiment of the invention in schematic sectional elevation.

DESCRIPTION OF THE PREFERRED EMBODIMENT

Turning now to the FIGURE, there is schematically shown an electron accelerator 1 and an after-connected scanner 2. The unit formed of the components 1 and 2 is closed off outwardly by a sealed electron outlet window 10. Underneath the electron beam generating system 1, 2 there is arranged an article 4 whose complex (non-planar) surface configuration is provided with a lacquer layer 5 to be cured. In essence, the article 4 has a first zone 4*a* which is relatively close to the outlet window 10 and a second zone 4*b* which is farther removed from the outlet window 10. A coated surface portion 6 is not accessible by direct electron beam radiation because of a radiation-impervious plate 11 or the like extending thereover.

In order to effect an irradiation of the hidden surface 6, in the vicinity of the zone 6 there is provided an article surface 7 which is exposed to a direct electron beam radiation and which is inclined (oblique) with respect to the direction of direct radiation and is oriented towards the hidden surface 6. While one part of the electrons impinging on the inclined surface 7 interacts with the atoms of the lacquer layer 5 and thus effects a curing thereof, another part 12 of the electrons penetrates the lacquer layer 5 without interacting with the atoms of the lacquer and, as illustrated in the FIGURE, is reflected from the upper face of the article 4 towards the hidden surface 6. The electrons thus penetrate the lacquer layer 5 of the inclined surface 7 twice: first, as they impinge thereon and second, after they are reflected from the upper surface of the article 4 and leave the lacquer layer. Some of the reflected electrons thus have a second chance to interact with the atoms of the lacquer layer through which they pass. Similar phenomena occur in the hidden surface 6. The electrons reflected onto the surface 6 penetrate the lacquer layer 5 thereon and a part of the electrons interacts with the atoms of the lacquer layer and the other part is reflected by the substrate. Because of the lesser electron velocity, a greater part of the electrons interacts with the atoms of the lacquer layer carried on the surface 6 than with those of the directly irradiated lacquer layer applied to the surface 7.

In order to avoid excessive irradiation of zones which lie close to the outlet window 10, such as portion 4*a*, in the vicinity of this article portion there is effected an intentional weakening of the electron beam (that is, there is effected an intentional decrease of the radiation intensity) by arranging an absorber 8 into the path of the electron beam. The absorber 8 may be a partially radiation-transparent foil or may have a sieve-like structure. In the described embodiment the absorber 8 also overlaps the inclined surface 7. In the zone of the inclined surface 7 the thickness of the absorber 8 gradually decreases in order to take into account the increasing distance of the surface 7 from the outlet window 10. In case a sieve-like structure is used, varying absorbtion properties may be obtained by varying the mesh sizes at predetermined areas of the absorber.

In principle, it is also feasible to effect a control of the electron beam itself in order to equalize the radiation intensity for the closer lying and farther lying coated areas, respectively. It is to be understood that such an electron beam control arrangement can be combined with the use of the above-described absorber (or absorbers).

In order to equalize the non-uniform energy losses of the electrons due to the non-uniform path lengths it is further feasible to deviate from the conventionally planar configuration of the outlet window 10 and design it instead such that it has a more complex surface configuration. For example, it is feasible to provide the outlet window in the zone of the relatively far-lying coated zone 4*b* with a projecting part 10*a* as shown in phantom lines in the FIGURE. The path through which the electrons would then travel at normal pressure, that is, at normal atmospheric conditions, would be approximately the same. Within the scanner 2 the electrons, to be sure, have to travel a greater distance in the zone of the projection 10*a*, such a longer travel, however, involves no appreciable losses because of the very low pressure prevailing there.

In order to be able to cure even those hidden surfaces which are not associated directly with an inclined reflecting surface (such as surface 7), advantageously directly irradiated scattering bodies 9 (only one shown) are provided which are positioned in the path on the electrons and are adapted in their surface geometry to that of the hidden areas 4*c*. The electrons impinging on the scattering bodies 9 are reflected thereby and are, with a sufficient intensity, directed towards the hidden zone 4*c*, so that a curing of the lacquer layer in the zone 4*c* is effected as well. Dependent upon the quality of the upper surface and the material of the scattering body 9, reflection factors of 0.5 may be achieved. The energy spectrum of the reflected electrons shows a distribution with a center of gravity which is significantly below that of the primary electrons.

It will be understood that the above description of the present invention is susceptible to various modifications, changes and adaptations and the same are intended to be comprehended within the meaning and range of equivalents of the appended claims.

What is claimed is:

1. In a method of curing a lacquer coating applied to an article of complex surface configuration, including the steps of generating and accelerating electrons, passing the electrons through an electron outlet window and directing the electrons onto the article for directly irradiating coated surfaces thereof; the article having a first surface portion inaccessible by direct electron irradiation; the improvement comprising the step of directing a part of the electrons to a second article surface portion which is directly accessible to electron irradiation and causing one part of the electrons to be reflected from said second surface portion onto said first surface portion for curing the lacquer coating on said first surface portion.

2. A method as defined in claim 1, further comprising the step of maintaining the intensity of the radiation of the electrons traversing said window at such a level that said first surface portion is bombarded with reflected electrons of such quantity and energy which are sufficient for curing the lacquer coating on said first surface portion of the article.

3. In an arrangement for curing, by electron beam irradiation, a lacquer coating carried on an article having a complex configuration, the arrangement including an assembly formed of an electron accelerator for obtaining highly accelerated, high-energy electrons and a scanner for forming, from the electrons, a spread-out electron beam directed onto the article through an electron outlet window sealing said assembly and allowing passage of the electrons from said assembly, the article having a first surface portion inaccessible to direct electron beam radiation passing through said window; the improvement wherein said article has, in the vicinity of at least one part of said first surface portion, a second surface portion arranged at an oblique angle with respect to the direction of the direct electron beam radiation and being exposed to said direct electron beam radiation; said second surface portion being oriented towards said first surface portion, whereby one part of the electrons impinging on said second surface portion is reflected therefrom onto the first surface portion and further wherein the shape of said window is adapted to the surface configuration of the article such that the distances between said window and at least approximately all article surfaces exposed to direct electron beam irradiation are at least approximately uniform.

4. An arrangement as defined in claim 3, further comprising an absorber positioned between said window and at least a part of article surfaces exposed to direct electron irradiation for absorbing one part of primary electrons passing through said window.

5. An arrangement as defined in claim 3, further comprising a scattering body supported spaced from said article in the vicinity of at least one part of said first surface portion; said scattering body being exposed to direct electron beam radiation and being arranged to reflect electrons towards said second surface portion; said scattering body including a reflecting surface having a configuration adapted to the shape of that part of said first surface portion with which the scattering body is associated.

* * * * *